US008677709B2

(12) United States Patent
DiLonardo et al.

(10) Patent No.: US 8,677,709 B2
(45) Date of Patent: Mar. 25, 2014

(54) COMPOSITE EXTERIOR SIDING PANEL WITH INTERLOCK

(75) Inventors: Brent A. DiLonardo, Liberty, MO (US); Eric B. Dickey, Overland Park, KS (US); John M. Wade, Pleasant Hill, MO (US); L. Rex Baxter, Excelsior Springs, MO (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 13/336,327

(22) Filed: Dec. 23, 2011

(65) Prior Publication Data

US 2013/0160387 A1 Jun. 27, 2013

(51) Int. Cl.
*E04D 1/00* (2006.01)

(52) U.S. Cl.
USPC ..... 52/533; 52/518

(58) Field of Classification Search
USPC ..... 52/518, 519, 520, 553, 533, 536, 539, 52/542, 478
See application file for complete search history.

(56) References Cited

U.S. PATENT DOCUMENTS

| | | | | | |
|---|---|---|---|---|---|
| 1,740,217 | A * | 12/1929 | Batcheller | 52/542 |
| 1,931,709 | A * | 10/1933 | Schaffert | 52/314 |
| 2,624,298 | A * | 1/1953 | Farren | 52/533 |
| 3,228,164 | A * | 1/1966 | Ettore | 52/539 |
| 3,284,967 | A * | 11/1966 | Elliott et al. | 52/58 |
| 3,783,570 | A * | 1/1974 | Storch | 52/520 |
| 4,580,383 | A * | 4/1986 | Pittman et al. | 52/520 |
| 4,754,589 | A * | 7/1988 | Leth | 52/538 |
| 6,625,939 | B1 * | 9/2003 | Beck et al. | 52/105 |
| 7,117,651 | B2 * | 10/2006 | Beck | 52/553 |
| 7,222,465 | B2 * | 5/2007 | Watson et al. | 52/592.6 |
| 7,472,523 | B2 * | 1/2009 | Beck | 52/748.1 |
| 7,748,181 | B1 * | 7/2010 | Guinn | 52/235 |
| 2009/0241459 | A1 * | 10/2009 | Bryan | 52/539 |

* cited by examiner

*Primary Examiner* — Andrew Triggs
(74) *Attorney, Agent, or Firm* — Lathrop & Gage LLP

(57) ABSTRACT

Disclosed herein is an interlocking siding panel system for securing to the side of a structure with planar surfaces. When the panel is secured to the structure through the nail strip a full contact strip opposite the nail strip lays flat against the structure causing the panel portion below an point of inflection in the panel to raise up off of the structure creating a gap to facilitate movement of moisture past a locking leg that integrates with the panel below.

16 Claims, 4 Drawing Sheets

COMPOSITE EXTERIOR SIDING PANEL WITH INTERLOCK

FIELD OF THE INVENTION

This disclosure pertains in general to a composite exterior siding panel that includes a system for interlocking panels that facilitate the downward movement of moisture away from the building structure. The disclosure also details how the system of interlocking panels limits the ability of wind to undermine the panels creating pressure differentials on the front and back surface that can dislodge the panel from the structure.

BACKGROUND OF THE INVENTION

Siding panels serve a two-fold objective of protecting a structure from damaging elements such as sunlight, moisture, hail and strong winds as well as providing an aesthetically appealing external appearance to the structure. The siding must be capable of protecting the structure from blisteringly hot sunlight that can induce thermal expansion and unattractive buckling of the siding. Siding produced from polyvinyl chloride (PVC) with organic and inorganic fillers has been shown to minimize thermal expansion and prevent or minimize the buckling of the siding when the solar heat load upon the structure is the greatest. The thermally stable siding is blended with high quality materials and is extruded with sufficient thickness to withstand large diameter hail impacts without permanent deformation. Panel siding must also minimize the infiltration of moisture from heavy wind blown rains and should moisture find its way behind the siding an exit route must be available to avoid the growth of mold and to prevent the rotting of any cellulosic structural elements such as plywood siding and structural framing or the oxidation of ferrous support members.

In addition to the capacity to withstand thermal loading, hail impacts and provide an escape route for moisture, well designed and installed exterior siding must be capable of withstanding high wind loadings. Siding panels that allow wind to gain access to the back surface, or the surface adjacent to the building structure, can experience tremendous loads capable of literally peeling the siding from the building. Consequently, the ability to seal both the upper and lower edges of the siding panel against panel courses above and below is critical to protecting the panels from the effects of strong wind loads.

Numerous siding panel designs exist in the market place; however, all are either lacking in some functional aspect or are prohibitively expensive, difficult to install or require extensive training and costly tools for proper installation. The consequence of such involved training and the acquisition of expensive tools is that these costs must ultimately be passed onto the consumer in order for the installer to experience a profit from her labors.

The product disclosed herein overcomes the adversities posed by wind, hail, rain, sun and complex installation procedures with a simple design that requires little training or sophisticated tools to properly install. In addition, the handsome wood grain exterior surface is aesthetically appealing with the warm textured feel of natural wood yet produced from a composite material that is highly resistant to fading, chipping, moisture damage, cracking and damage by insects.

It is an object of the invention to provide a composite exterior siding panel that is thermally stable and that will not buckle or warp even under the most extreme solar heat loads.

It is another object of the invention to provide an aesthetically appealing exterior surface that replicates a natural wood grain.

It is another object of the invention to provide a composite exterior siding panel that is lightweight and easy to install by an untrained homeowner with standard tools.

It is another object of the invention to provide a composite exterior siding panel that is tough, durable and capable of withstanding impacts from large diameter hail.

It is another object of the invention to provide a composite exterior siding panel that facilitates drainage of moisture trapped between the paneling and the building structure through weep slots in the rear face of the panel that start near the first flat and proceed past the inflection point of the panel.

It is another object of the invention to provide a composite exterior siding panel that includes a locking leg extending rearwardly from the back face of the panel and that also extends nominally downwardly toward the bottom edge of the panel and that extends longitudinally along the entire length of the panel. The locking leg creates a pocket for insertion of the top edge of a second panel disposed below the first panel to precisely define the positional relationship between the first and second panels.

It is another object of the invention to provide a composite exterior siding panel with a top portion and a bottom portion of a panel separated by an inflection point such that the top and bottom portions diverge at approximately 5 degrees so that when the panel is secured to the side of a structure at the nail strip the panel portion below the inflection point extends away from the building surface. In addition, when installed against a structural wall, the bottom surface of the locking leg is separated from the structural wall by a gap of from 0.020 to 0.060. The gap between the locking leg and the surface of the wall facilitates movement of moisture from upper panel courses to lower panel courses and ultimately to ground level thereby limiting contact with building surfaces that would deteriorate if exposed to the moisture for extended periods of time.

SUMMARY

The composite exterior siding panel with interlock system disclosure is directed to a panel capable of protecting a structure from damaging elements such as sunlight, moisture, hail and strong winds as well as providing an aesthetically appealing external appearance to the structure. In a preferred embodiment the siding panel comprises an extruded composite material of polyvinyl chloride that includes a combination of organic and inorganic fillers that increase the panel's durability, resistance to mold growth, resistance to deformation from hail impacts and overall structural strength.

The disclosed siding panel comprises a panel with a front face and a back face along with a top edge and a bottom edge. As is typical with siding panels, the panel course above partially overlaps the panel course below and the description below effectively outlines a system for building multiple courses of panels stacked atop and interlocking with one another on the side of a building.

The disclosed siding panel also includes a top portion of the panel and a bottom portion, the top and bottom portions of the panel diverge from one another at an inflection point. These diverging panel portions facilitate the formation of a path for moisture to travel between panel courses as will be discussed in greater detail below. The disclosed siding panel includes a flange extending substantially perpendicularly from the back face of the panel adjacent the bottom edge as well as a locking leg with a flat pad. The flange and locking leg with a flat pad run longitudinally along the entire length of the panel as do all features described below unless otherwise noted.

The locking leg backside in concert with the back face of the panel form a pocket for insertion of the top edge of a separate panel positioned in a lower panel course. The composite panel also includes a nail strip extending longitudinally along the entire front face of the panel proximate the top edge of the panel to be used in securing the panel to the wall with nails, screws and other securement means. The panel also includes a full contact strip extending longitudinally along the entire back face of the panel proximate the top edge of the panel which serves as the panel's only longitudinally extending area of contact with the wall surface.

After the first course of paneling is applied to the structure the pocket formed by the locking leg backside and the back face of the panel on the second course is positioned over the top edge of the first panel secured to the structure. Once the top edge of the first panel is positioned within the locking leg pocket of the second course, the second course is secured to the structure through the nail strip causing the full contact strip to lay flat against the structure. When a panel is secured to the structure at the full contact strip the entire back face of the panel below the inflection point, including the flat pad of the locking leg, raises off of the structure. Since no features of the back side of the panel below the inflection point are in contact with the wall surface an unobstructed path is created for moisture to flow downward with the aid of gravity.

Once moisture reaches the next lowest panel course it encounters the bottom edge of the first flat proximate the top edge of the panel where weep slots are installed to further facilitate the movement of moisture downward. The weep slots are installed with a separation distance of between 3 and 16 inches with a preferred diameter of about 3/16 inch. The weep slots originate proximate the bottom edge of the first flat and extend past the inflection point thereby allowing moisture to travel past the full contact strip which is firmly pressed against the wall by nails or screws passing through the nail strip. Failing to include weep slots would cause moisture to pool atop the first flat thereby potentially contributing to deterioration of the wall structure due to mold growth or structural member damage. Additionally, without weep slots moisture could become trapped behind the panel during a freeze thaw cycle thereby causing the moisture to expand and push the panels away from the structure loosening the connection to the building.

An additional feature of the disclosed panel is a flange extending substantially perpendicularly from the back face of the panel adjacent the bottom edge. When a second and further courses are installed the flat of the panel flange positioned above lands squarely and firmly on the front face of the lower panel course. The flange serves an aesthetic purpose of simulating a real wood panel that has sufficient thickness to overlap the panel course positioned below. Additionally, the flange serves to limit the intrusion of both high speed winds and wind blown moisture. High speed winds that enter beneath the bottom edge of panels that are not secured at the nail strip can catastrophically peel one or many panels from the wall surface. The flange effectively provides a wind and rain shield keeping the elements from intruding behind the panels and allowing the front face of the panel to provide protection for the structure.

Various objects, features, aspects and advantages of the inventive subject matter will become more apparent from the following detailed description of preferred embodiments, along with the accompanying drawing in which like numerals represent like components.

DETAILED DESCRIPTION

Figure 1:
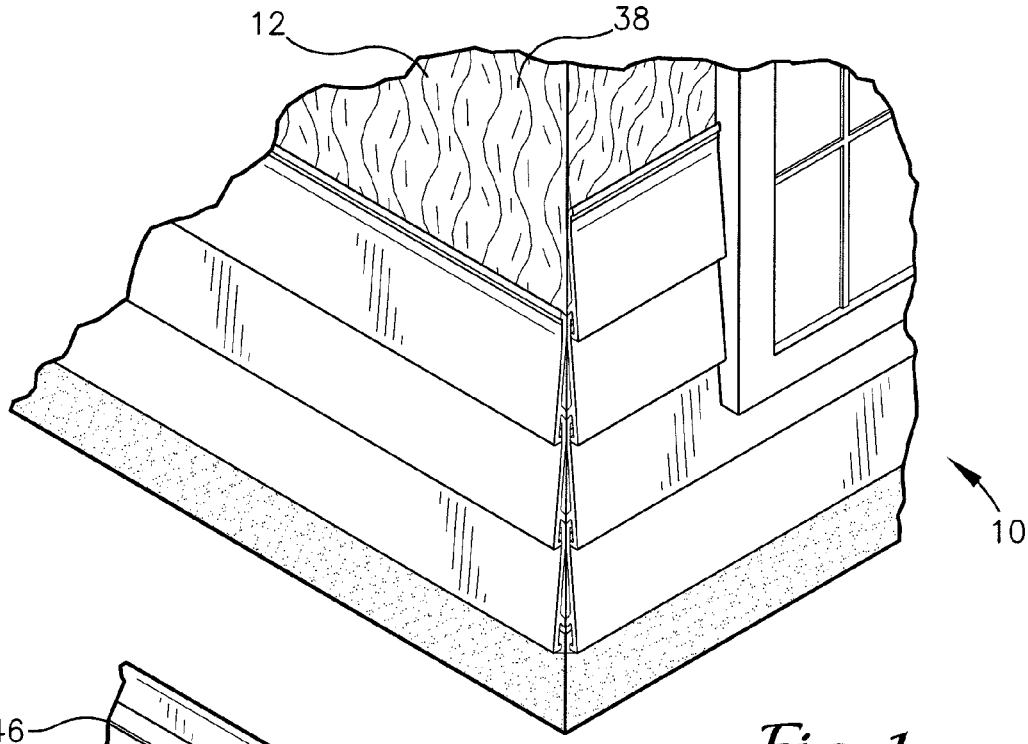
FIG. 1 is a perspective view of an embodiment of the siding panels secured to the side of a building.

FIG. 1 illustrates a structure 12 with several courses of exterior siding panels 10 installed thereon. The siding panels 10 can be extruded in many different widths with 4 and 7 inches the industry preferred panel widths. The panels are installed beginning at the lowest level and courses are installed progressively higher until the desired portion of the wall 38 is covered. The panels 10 are preferably extruded using a polyvinyl chloride composition with organic and inorganic fillers that contribute to thermally stabilizing the panels so that when exposed to intense solar heat the panels do not substantially expand and contract causing problems with panel buckling and loosening of the nails that anchor the panels 10 to the building wall 38. The polyvinyl chloride in conjunction with the specially formulated organic and inorganic fillers produces a mechanically tough and resilient panel that is resistant to deformation from impacts such as hail and thrown objects as well as being resistant to insect damage and mold growth.

Figure 2:
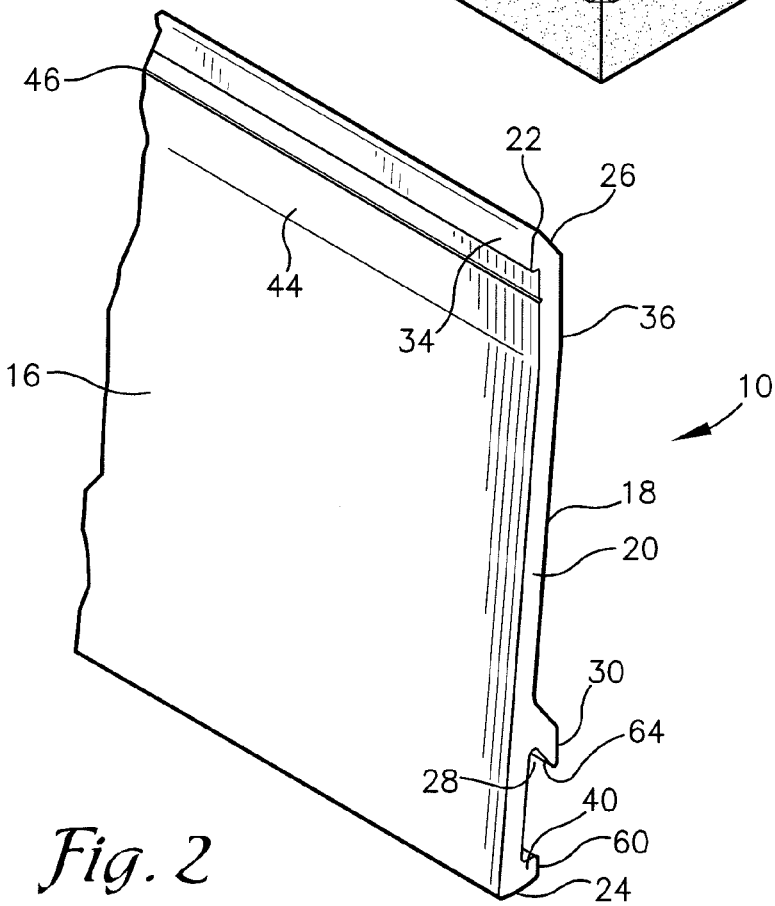
FIG. 2 is a perspective view of a portion of an embodiment of a single panel.

As seen in FIG. 2, the panel 10 is comprised of a front face 16 and a back face 18 opposite the front face. The front face 16 and the back face 18 are separated by a panel thickness 20 that is in the range of from 0.25 to 0.35 inches and preferably about 0.280 inches; however, this thickness may be optimized depending upon the width of the panel that is being produced. This thickness of the material provides sufficient structural rigidity to keep the panels from permanently deforming during severe hail storm events yet is sufficiently thin to minimize the weight of a long panel thereby facilitating ease of installation. The front face 16 of the panel is preferably texturized to simulate natural wood grain; however, smooth untexturized surfaces are also an option.

Figure 3:
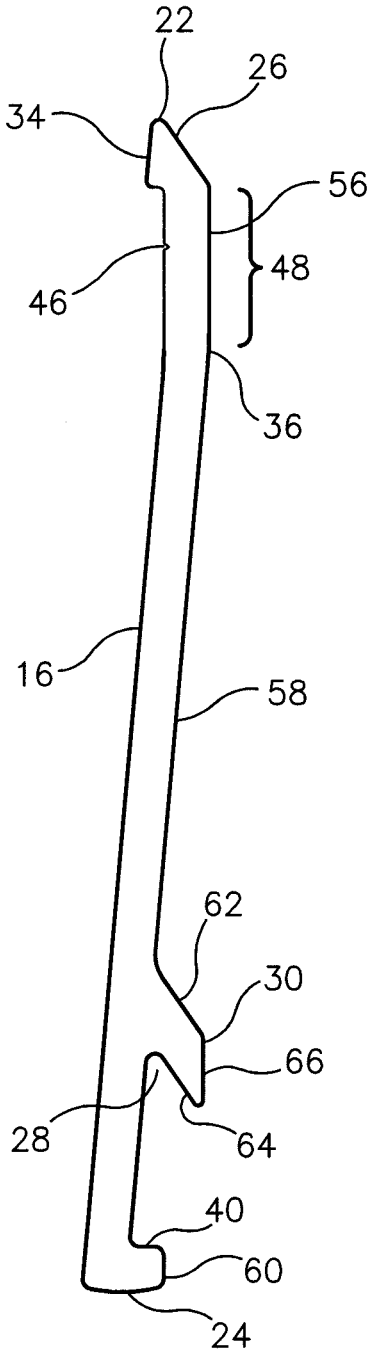
FIG. 3 is a side elevation view of an embodiment of a single siding panel.
Figure 4:
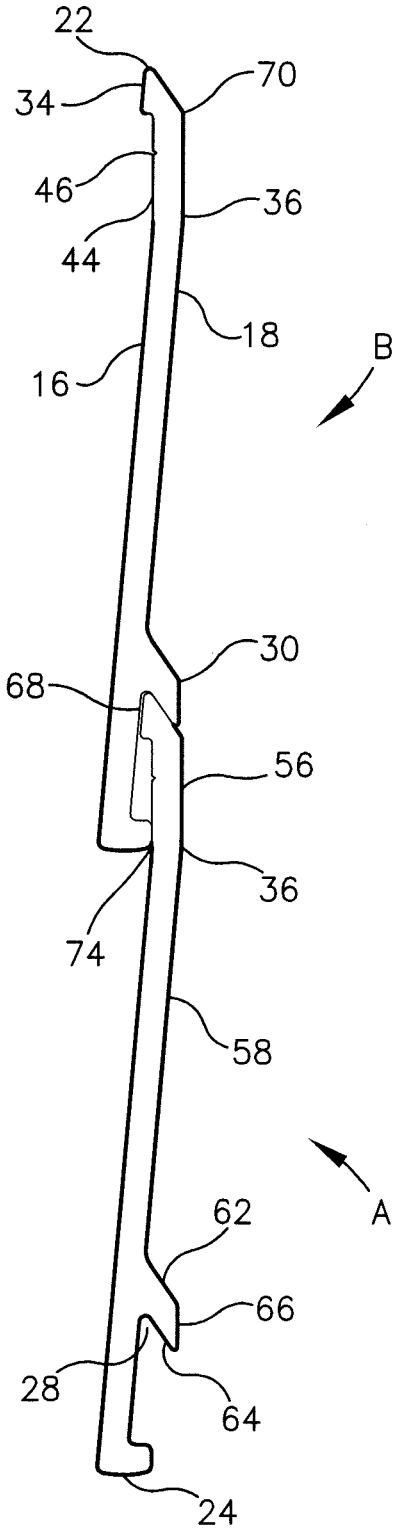
FIG. 4 is a side elevation view of an embodiment of two interlocked siding panels.

All features described below run the entire length of the panel 10 unless otherwise stated. As best seen in FIGS. 3 and 4, the panels include a top edge 22 and a bottom edge 24 opposite the top edge. The top of the panel 10 includes a first flat 26 angled at approximately 35 degrees from the plane of the back face 18 that, when installed, rests in the pocket 28 formed by the locking leg 30 of panel B as seen in FIG. 4, disposed immediately above the first panel A. The first flat 26 rests against the inner surface 64 of the locking leg 30 and is used to control the vertical positioning of panel B that is being positioned atop panel course A. On the opposite side of the top edge 22 from the first flat 26, as seen in FIG. 4 is a second flat 34 that when interlocked with panel B rests against the back face at 68 immediately below the locking leg 30. The second flat 34 serves to further stabilize the bottom portion of panel B and provide the panel course located above with rigidity as it is disposed beneath the locking leg 30.

Below the top edge 22 of the panel 10 is a point of inflection 36 separating the panel into a top portion 56 and a bottom portion 58 that directionally diverge from one another at an angle in the range of between 3 and 7 degrees. The inflection angle is preferably 5 degrees; however, this angle may vary depending upon the specific dimensions of the panel 10.

At the bottom edge 24 of the panel 10 is a flange 40 extending substantially perpendicularly from the back face of the panel adjacent the bottom edge 24. The flange 40 has a flange face 60 that when the panel is in position against the wall rests atop the front face 16 of the top portion 56 of the panel 10 as shown at reference number 74. In addition to the flange 40, and as previously discussed, is a locking leg 30 in proximity to the bottom edge 24 extending outwardly from the back face 18 and in the direction of the bottom edge 24. The locking leg 30 includes a front side 62, a back side 64 and a flat 66. As discussed above, the locking leg back side 64 in conjunction with a segment 68 of the panel back face forms a pocket 28 for insertion of the top edge 22, first flat 26 and second flat 34 of panel A positioned therebelow. The pocket 28 has a radius in the range of 0.040 to 0.080 inches and preferably a radius of 0.060 inches.

Figure 5:
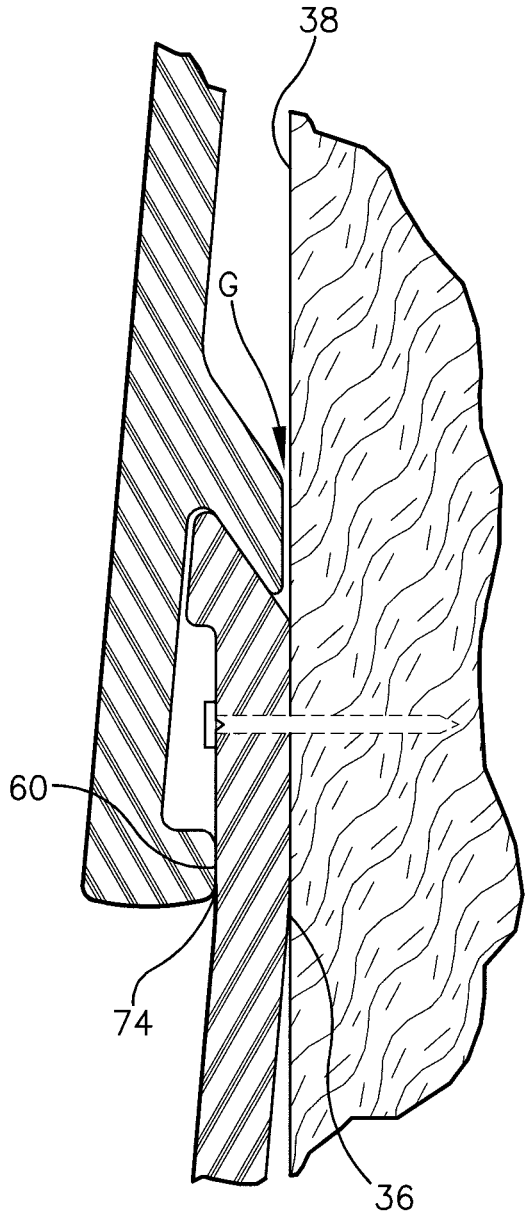
FIG. 5 is a side elevation view of an embodiment of two interlocked siding panels secured to the side of a building.

As best seen in FIG. 5, the bend in the panel at the inflection point 36 causes the lower portion of the panel 58 to rise up off of the wall 38 leaving the wall untouched by the panel beneath the inflection point 36. Even the locking leg flat 66 remains out of contact with the wall 38 with the panel inflection producing a gap G between the wall and the locking leg flat 66 in the range of 0.025 to 0.0375 inches. This gap G between the locking leg flat and the wall is preferably 0.030 inches to facilitate the drainage of water down the wall 38 past the panel backside and the locking leg flat 66.

As seen in FIG. 2, at the opposite end of the panel near the top edge 22 is a nail strip 44 that extends longitudinally along the entire front face 16 of the panel. The nail strip 44 has at its center a score line 46 into which the tips of nails should be hammered or screws threaded into the structural wall 38 behind the panel 10 as visualized in FIG. 5. On the back face 18 of the panel 10 opposite the nail strip 44 is a full contact strip 48 extending longitudinally along the entire back face 18 of the panel 10. The full contact strip 48 has an upper boundary 70 and a lower boundary that is coincident with the inflection point 36 defining the width of the strip. The full contact strip 48 is a flat strip that rests against the wall 38 when the panel 10 is secured to the wall 38 with nails or screws.

Figure 6:
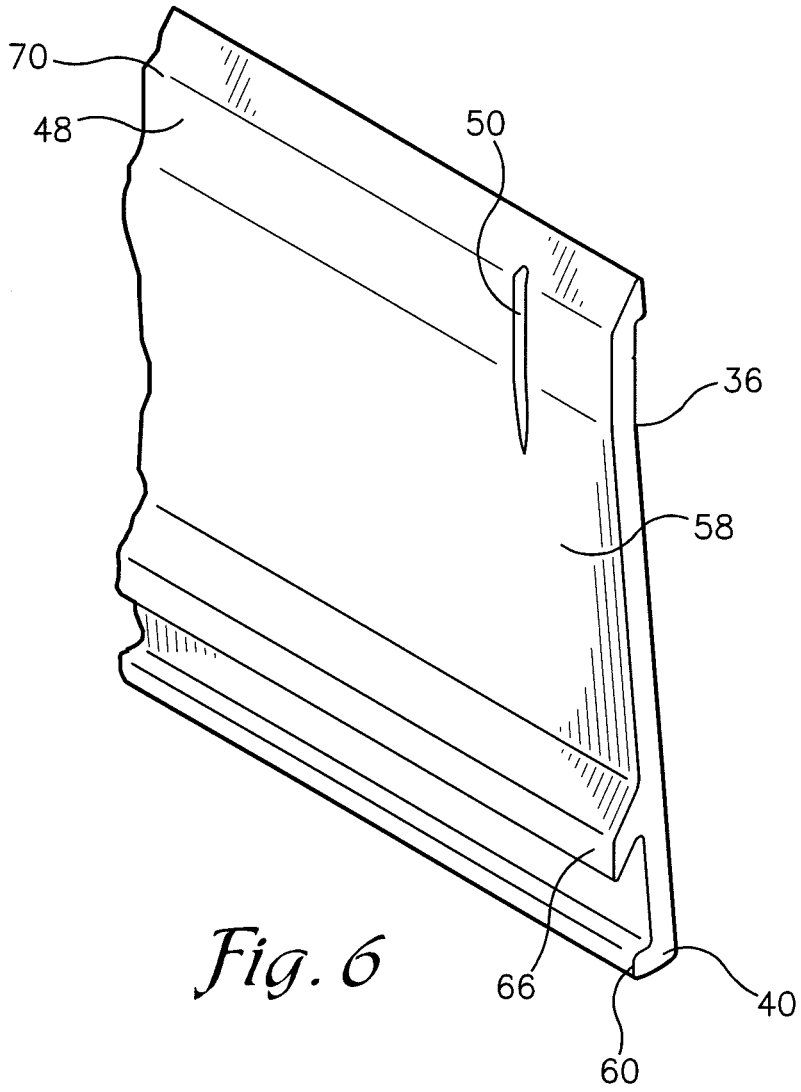
FIG. 6 is a rear perspective view of an embodiment of a single siding panel revealing a weep slot.

As best seen in FIG. 6, weep slots 50 are also included on the back face 18 of the panel 10 to facilitate the transfer of moisture away from behind the panels. These weep slots 50 begin at the upper boundary 70 of the full contact strip 48 and extend downwardly past the inflection point 36 where they terminate in the panel bottom portion 58 away from the wall 38.

In operation, a first course of paneling 10 is positioned against the lower level of the structural wall 38 and confirmed to be level. Next, nails, screws or other appropriate securement means are used to secure the full contact strip 48 of the first panel firmly against the wall 38 through the score line 46 in the nail strip 44 on the front surface 16. As previously discussed, the panel 10 utilizes an inflection point 36 that produces directional divergence between the panel top portion 56 and the panel bottom portion 58 in the range of between 3 and 7 degrees and preferably at about 5 degrees. Consequently, nailing the panel to the wall 38 such that the full contact strip 48 is positioned against the wall 38 causes the panel bottom portion 58, including the locking leg 30, to raise up off of the wall 38. Moisture can exit the area of the first flat 26 by passing through the weep slots 50 which are preferably spaced apart from 3 to 16 inches thereby giving trapped water an opportunity to escape. This moisture moves along the same path past each successive panel until it reaches the lower most surface of the structure where it is discharged to the ambient environment.

Once the first course A is secured to the wall, the locking leg 30 of the second course B is placed over the top edge 22 of the first course A. The locking leg of the second course panel effectively holds the second course in position atop the first course and since the first course A was previously leveled the second course B will remain level. The top edge 22, first flat 26 and second flat 34 all cooperatively engage with the pocket 28 behind the locking leg 30 to form a rigid and secure interlock between successive courses of panels.

Another functional feature of the overall panel design is the flange 40 located at the bottom edge 24. The flange face 60 serves to contact the top portion 56 front face 16 as shown at reference number 74. The flange 40 also serves to prevent or greatly limit the infusion of air behind the panel 10 during strong wind events which can result in the panel being ripped from the surface 38 of the building. Additionally, the flange 40 greatly minimizes or prevents the infusion of water during rain storm and high wind events that can lead to water being trapped behind the siding saturating cellulose based building materials that can rapidly grow mold causing environmental as well as structural problems.

While the preferred form of the present invention has been shown and described above, it should be apparent to those skilled in the art that the subject invention is not limited by the figures and that the scope of the invention includes modifications, variations and equivalents which fall within the scope of the attached claims. Moreover, it should be understood that the individual components of the invention include equivalent embodiments without departing from the spirit of this invention.

We claim:

1. A siding panel for securing to the wall of a structure, the siding panel comprising:

a front face and a back face;

a top edge and a bottom edge;

a top portion and bottom portion of the panel that are separated by an inflection point wherein the top and bottom portions directionally diverge;

a locking leg extending longitudinally along the entire back face of the panel, the locking leg including a front side, a back side and a flat, the locking leg extending outwardly from the bottom portion of the back face and in the direction of the bottom edge, the locking leg and the panel back face forming a pocket for insertion of the top edge of a panel positioned therebelow;

a flange with a face, the flange face substantially perpendicular to the panel bottom edge, the flange extending substantially perpendicularly from the back face of the panel adjacent the bottom edge, wherein when a second panel course is installed on a wall above a first panel course the flange of the second course rests upon the first panel top portion front face sealing both panels against infiltration of wind and water;

a nail strip extending longitudinally along the entire front face of the panel proximate the top edge of the panel;

a full contact strip with an upper and lower boundary, the full contact strip extending longitudinally along the entire back face of the panel proximate the top edge of the panel, the full contact strip disposed opposite the nail strip on the front face of the panel;

at least one weep slot with a diameter in the range of about 0.10 to about 0.20 inches extending from the full contact strip upper boundary to below the inflection point, the at least one weep slot facilitating the downward migration of moisture;

wherein when the panel is secured to the structure through the nail strip the full contact strip lays flat against the wall causing the bottom portion of the panel to raise up off the wall thereby creating a gap between the bottom portion of the panel back face including the locking leg flat in order to facilitate downward movement of moisture past the locking leg.

2. The siding panel of claim 1, wherein the panel is comprised of a composite material.

3. The siding panel of claim 1, wherein the locking leg extends outwardly from the back face of the panel in the range of from 0.25 to 0.375 inches.

4. The siding panel of claim 1, wherein the flange extends outwardly from the back face of the panel in the range of from 0.125 to 0.25 inches.

5. The siding panel of claim 1, wherein the angle of inflection between the panel top portion and the panel bottom portion is in the range of from 2 to 7 degrees.

6. The siding panel of claim 1, wherein when the full contact strip is secured against the building surface the angle of inflection between the panel top portion and bottom portion causes the locking leg flat to extend away from the wall in the range of from 0.020 to 0.040 inches.

7. The siding panel of claim 1, wherein the nail strip is disposed approximately 0.5 inches below the top edge of the siding panel.

8. An interlocking siding panel system for securing to the side of a structure, the siding panel system comprising:

a first panel disposed beneath a second panel wherein each panel comprises;

a front face and a back face opposite the front face;

a top edge and a bottom edge, the bottom edge opposite the top edge;

a panel top portion and a panel bottom portion, the top portion and the bottom portion separated by an inflection point wherein the top and bottom portions directionally diverge;

a locking leg extending longitudinally along the entire back face of the panel, the locking leg including a front side, a back side and a flat, the locking leg extending outwardly from the bottom portion of the back face and in the direction of the bottom edge, the locking leg and the panel back face of the second panel forming a pocket for insertion of the top edge of the first panel positioned therebelow;

a flange with a face, the flange face substantially perpendicular to the panel bottom edge, the flange extending substantially perpendicularly from the back face of the panel adjacent the bottom edge, wherein when a second panel course is installed on a wall above a first panel course the flange of the second course rests upon the first panel top portion front face sealing both panels against infiltration of wind and water;

a nail strip extending longitudinally along the entire front face of the panel proximate the top edge of the panel;

a full contact strip with an upper and lower boundary, the full contact strip extending longitudinally along the entire back face of the panel proximate the top edge of the panel, the full contact strip disposed opposite the nail strip on the front face of the panel;

at least one weep slot with a diameter in the range of about 0.10 to about 0.20 inches extending from the full contact strip upper boundary to below the inflection point, the at least one weep slot facilitating the downward migration of moisture;

wherein when the second panel is secured to the structure through the nail strip the full contact strip lays flat against the wall causing the bottom portion of the second panel to raise up off the wall thereby creating a gap between the bottom portion of the panel back face including the locking leg flat in order to facilitate downward movement of moisture past the locking leg.

9. The siding panel of claim 8, wherein the thickness of the panel is in the range of between 0.2 and 0.4 inches.

10. The siding panel of claim 8, wherein the panel is comprised of an extruded composite material.

11. The siding panel of claim 8, wherein the locking leg extends outwardly from the back face of the panel in the range of from 0.20 to 0.40 inches.

12. The siding panel of claim 8, wherein the flange extends outwardly from the back face of the panel in the range of from 0.10 to 0.30 inches.

13. The siding panel of claim 8, wherein the angle of inflection between the panel top portion and the bottom portion is in the range of from 2 to 7 degrees.

14. The siding panel of claim 8, wherein when the full contact strip is secured against the building surface the inflection between the panel top portion and bottom portion causes the locking leg flat to extend away from the wall in the range of from 0.020 to 0.050 inches.

15. The siding panel of claim 8, wherein the nail strip is disposed approximately 0.5 inches below the top edge of the siding panel.

16. The siding panel of claim 8, wherein when secured in position the flange face of the second panel contacts the front face of the first panel limiting infiltration of wind beneath the second panel.

* * * * *